US009149684B1

(12) United States Patent
Carlson et al.

(10) Patent No.: US 9,149,684 B1
(45) Date of Patent: Oct. 6, 2015

(54) CLIMBING TOOL

(71) Applicants: Benjiman G. Carlson, New York, NY (US); George Fisher, Oxon (GB)

(72) Inventors: Benjiman G. Carlson, New York, NY (US); George Fisher, Oxon (GB)

( * ) Notice: Subject to any disclaimer, the term of this patent is extended or adjusted under 35 U.S.C. 154(b) by 0 days.

(21) Appl. No.: 14/159,651

(22) Filed: Jan. 21, 2014

Related U.S. Application Data

(60) Provisional application No. 61/763,719, filed on Feb. 12, 2013.

(51) Int. Cl.
*B63B 29/08* (2006.01)
*A63B 29/08* (2006.01)

(52) U.S. Cl.
CPC ..... *A63B 29/08* (2013.01)

(58) Field of Classification Search
CPC .... A63B 29/00; A63B 29/024; A63B 29/025; A63B 29/08; A63B 29/028; B25F 1/00; B25D 1/04
USPC ..... 248/925, 216.1, 231.9, 231.91; 30/308.1, 308.3, 381; 7/145
See application file for complete search history.

(56) References Cited

U.S. PATENT DOCUMENTS 4,199,632 A * 4/1980 Travis ..... 428/54
4,308,628 A * 1/1982 Kunberger et al. ..... 7/145
4,432,404 A 2/1984 Clark et al.
5,425,176 A 6/1995 Brainerd et al.
5,768,727 A * 6/1998 Brainerd ..... 7/145
5,996,235 A 12/1999 Brainerd
D448,639 S 10/2001 Petzl
D448,640 S 10/2001 Petzl
7,225,544 B2 * 6/2007 Petzl ..... 30/381
7,533,469 B2 * 5/2009 Skrivan et al. ..... 30/308.1
7,565,711 B1 * 7/2009 Schamadan ..... 7/145
2005/0144731 A1 7/2005 Petzl
2010/0139008 A1 6/2010 Janzen

OTHER PUBLICATIONS

Anonymous, online catalog for Petzl, http://www.petzl.com/us/outdoor/ice-axes-0.
Anonymous, online catalog for Grivel, http://www.grivel.com/products/full_product_list/fpl_ice_axes.
Anonymous, online catalog for Black Diamond Mountain Sports, http://blackdiamondequipment.com/en/climbing/ice-axes-piolets.
Anonymous, online catalog for Trango, http://www.trango.com/ice_gear.

* cited by examiner

*Primary Examiner* — Nkeisha Smith
(74) *Attorney, Agent, or Firm* — Werschulz Patent Law, LLC

(57) ABSTRACT

A climbing tool operative for climbing an artificial climbing wall, simulating dry tooling, ice climbing and mixed climbing. The tool has a strap replacing the axe portion used in outdoor climbing, the strap engaging a climbing wall hold. The tool has a grip attached to an angled shaft. The grip has a grasping portion for a hand that includes a pinky rest and a finger rest. The grip has a match rest for a second hand to grasp the tool above the grip in a "match maneuver." The grip has an inward bias toward the wall from the shaft at about 160 degrees, and the angle in the shaft portion is about 160 degrees, providing an appropriate skeletal wrist angle when the tool is grasped. Because the climbing tool does not have any sharp points or edges, it does not damage an artificial climbing wall.

3 Claims, 5 Drawing Sheets

CLIMBING TOOL

CROSS-REFERENCE TO RELATED APPLICATIONS

This application is a nonprovisional utility application of the provisional patent application, Ser. No. 61/763,719 filed in the United States Patent Office on Feb. 12, 2013 and claims the priority thereof and is expressly incorporated herein by reference in its entirety.

TECHNICAL FIELD

The present disclosure relates generally to a climbing tool. More particularly, the present disclosure relates to a tool for climbing an artificial climbing wall.

BACKGROUND

Dry tooling involves climbing rock with climbing axes to traverse areas without ice or snow. It has its origins in traditional climbing, but it has developed into a relatively new and exciting kind of sport. The range of techniques created as well as the necessary skill required allowed dry-tooling to become a sport of its own, rather than a mere extension of other types of climbing.

Specific types of dry tooling axes have been developed so that the tips of the axe picks stay in the smallest of holds. The tip of the pick does most of the load bearing. The axe must be placed in the same direction as the load and the climber must maintain the same direction of loading on the shaft during the movement.

Many dry tool climbers, as well as ice climbers, use artificial climbing walls to improve techniques. However, generally artificial climbing walls are designed to simulate rock climbing and are not designed for use with any type of axe, particularly those used in other types of climbing.

While conventional tools may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a safe, effective, and versatile way to train for dry tooling, ice climbing and mixed climbing on an artificial climbing wall. Accordingly, the present disclosure provides a climbing tool that is operative for climbing an artificial climbing wall, simulating a plurality of motions of outdoor climbing.

Another aspect of an example embodiment in the present disclosure is to provide a tool for climbing on an artificial climbing wall without damaging the wall while simulating dry tooling, ice climbing and mixed climbing. Accordingly, the present disclosure provides a climbing tool that lacks sharp points and edges, the climbing tool preventing damage to an artificial climbing wall.

A further aspect of an example embodiment in the present disclosure is to provide a tool for safely climbing on an artificial climbing wall that prevents an injury to a user or other climbers. Accordingly, the present disclosure provides a climbing tool that lacks a spike, a hammer, and an adze found on ice axes, preventing injury to a user or other climbers from a precariously placed or falling tool.

The present disclosure describes a climbing tool operative for climbing an artificial climbing wall, simulating dry tooling, ice climbing and mixed climbing. The tool has a strap replacing the pick portion used in outdoor climbing, the strap engaging a climbing wall hold. The tool has a grip attached to an angled shaft. The grip has a grasping portion for a hand that includes a pinky rest and a finger rest. The grip has a match rest for a second hand to grasp the tool above the grip in a "match maneuver" as explained hereinbelow. The grip has an inward bias toward the wall from the shaft at about 160 degrees, and the angle in the shaft portion is about 160 degrees, providing an appropriate skeletal wrist angle when the tool is grasped. Because the climbing tool does not have any sharp points or edges, it does not damage an artificial climbing wall.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
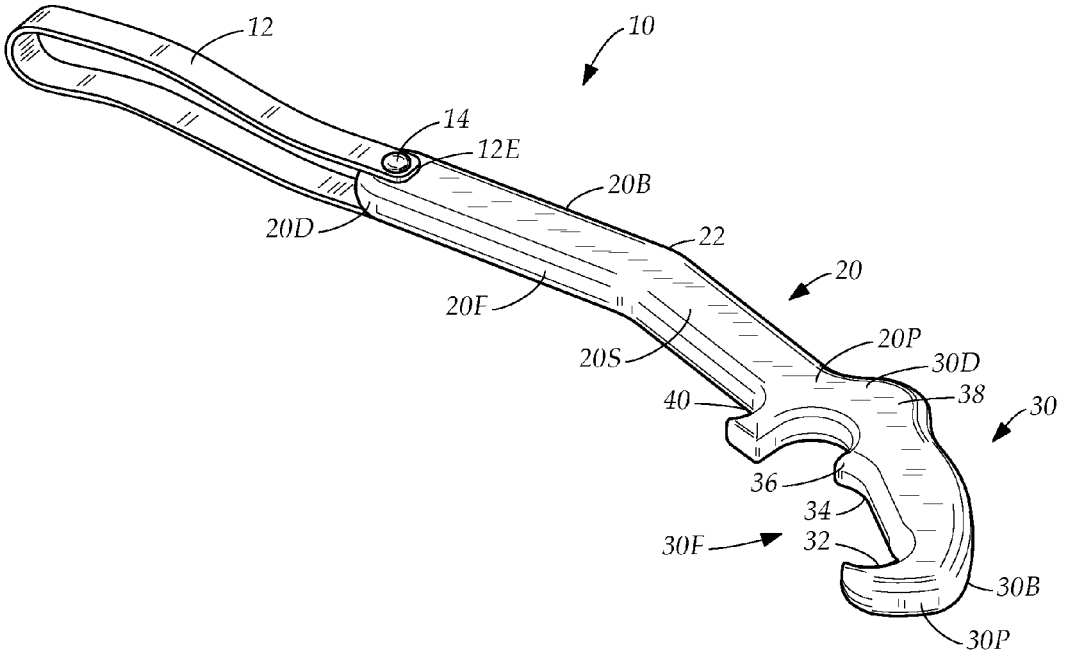
FIG. 1 is diagrammatic perspective view of a climbing tool.

FIG. 1 illustrates an example embodiment of a climbing tool 10 operative for climbing an artificial climbing wall.

Using the tool 10 on an artificial climbing wall is a safe, effective, and versatile way to train for dry tooling, ice climbing and mixed climbing. Using the tool 10 simulates a plurality of motions of outdoor climbing in a safe, controlled environment and emulates gripping an ice climbing axe.

The tool has an angled shaft 20 having a distal end 20D and a proximal end 20P and an obtuse angle 22 therebetween.

The tool has a strap 12 attaching to the distal end of the shaft by a fastener 14. The strap has a pair of ends 12E. The strap 14 is operative for engaging a hold on a climbing wall as explained hereinbelow.

The shaft 20 has a front 20F and a back 20B. The fastener 14 couples the ends 12E of the strap to a hole in the shaft, the shaft having a pair of opposing sides 20S and the hole from a first side to a second side therethrough. The fastener 14 is, for example, but not limited to a bolt, a rivet, a pin or other similar fasteners that are well to those of ordinary skill. In another embodiment, each end 12E of the strap 12 is fastened by a separate fastener 14, one fastener 14 coupling one strap end to each side of the shaft.

The tool 10 has a grip 30. The grip 30 has a front 30F and an opposing back 30B facing away from an artificial climbing wall when climbing. The grip 30 further has a proximal portion 30P and a distal portion 30D. The distal portion 30D of the grip attaches to the proximal end 20P of the shaft 20 at an angle biasing inward toward the front portion 30F as explained hereinbelow.

The grip 30 has a pinky rest 32 at the front 30F proximal end 30P, a grasping portion 34 between the proximal portion 30P of grip and the distal portion 30D of the grip, a finger rest 36 in the grasping portion, the finger rest 36 protruding to the front 30F, a thumb rest 38 at the distal portion 30D protruding to the back 30B, and a match rest 40 at the distal portion 30D protruding to the front 30F.

The pinky rest 32 is a small, semi-circular lip that is fixed in place because it is not necessary to adjust to bulky climbing gloves. It is understood by those of ordinary skill that the term pinky is commonly associated with the smallest finger on a human hand and the pinky rest is provided for said finger.

The grip 30 is operative for ergonomically grasping the climbing tool by a user. The grip is operative for a user using a plurality of positions on the grip for leveraging a load upward when climbing the artificial climbing wall.

The grip 30 of the tool 10 is about one inch in thickness, and is specifically thicker than other dry tools so that it has a larger radius for rounding the tool for comfort when used without gloves or with gloves typically thinner than those used outdoors. The thicker grip also provides more gripping surface area, distributing the force over a larger surface area, providing more comfort. When gripping the tool, the user experiences a close simulation of an ice axe grip.

In one embodiment, the grip 30 is integral to the shaft 20. In another embodiment, the shaft 20 and grip 30 are preferably manufactured from wood. However, the shaft and grip can be manufactured from, for example, but not limited to, steel, titanium, or molded resin.

Figure 2A:
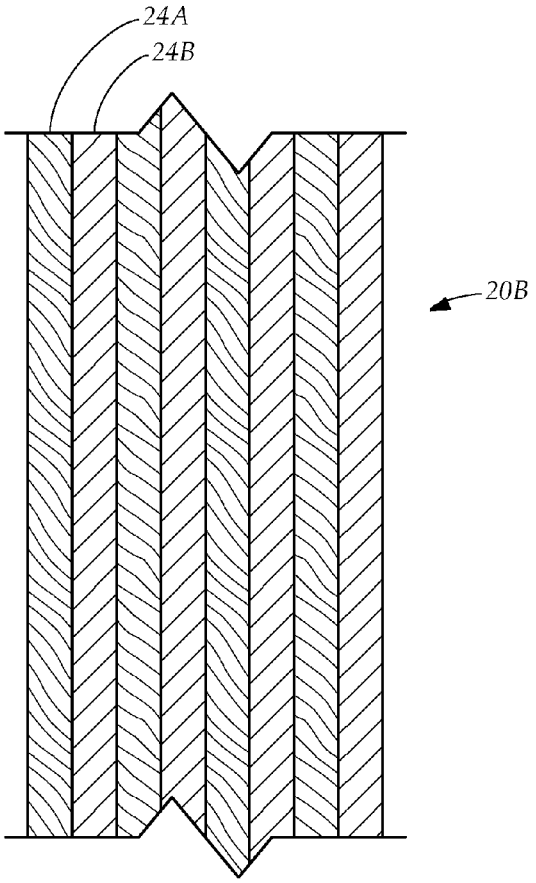
FIG. 2A is a cross section of an example embodiment of the climbing tool showing a plurality of layers forming a shaft and a grip.
Figure 2B:
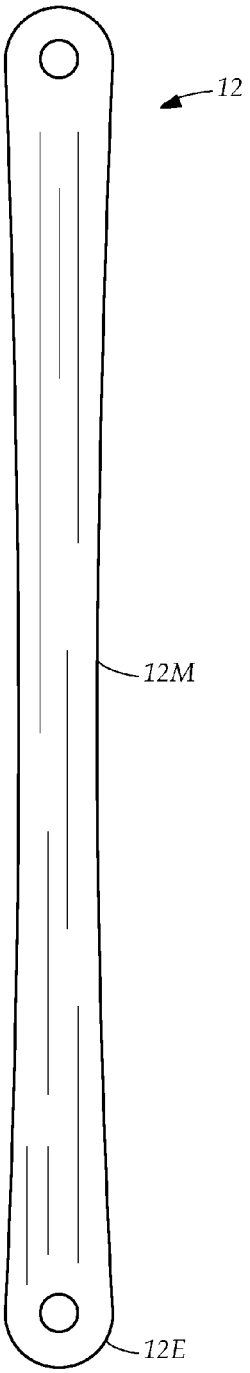
FIG. 2B is a top plan view of a strap of the climbing tool.

As drawn in FIG. 2B, the strap 12 is flat, smooth, having an essentially uniform surface, with a slight taper in width and lacking notches. The strap is operative for grabbing a hold with less positivity, such as a convex top hold, as well as a concave top hold. The strap has a middle portion 12M between the strap ends 12E, the middle portion slightly tapered inwardly from the ends, operative for providing more purchase. The smooth flat unnotched strap 12 provides more friction than a strap having notches. The essentially uniform width with the slight taper of the strap 12 is operative for minimizing wear and tear of the strap. In one embodiment, the strap 12 is preferably manufactured from rubber but similar materials are possible within the inventive concept.

The strap 12 of the tool 10 replaces an axe blade of an ice climbing axe, the strap looping over the hold in the artificial wall in the same pulling motion used when employing an outdoor ice climbing axe.

Figure 3:
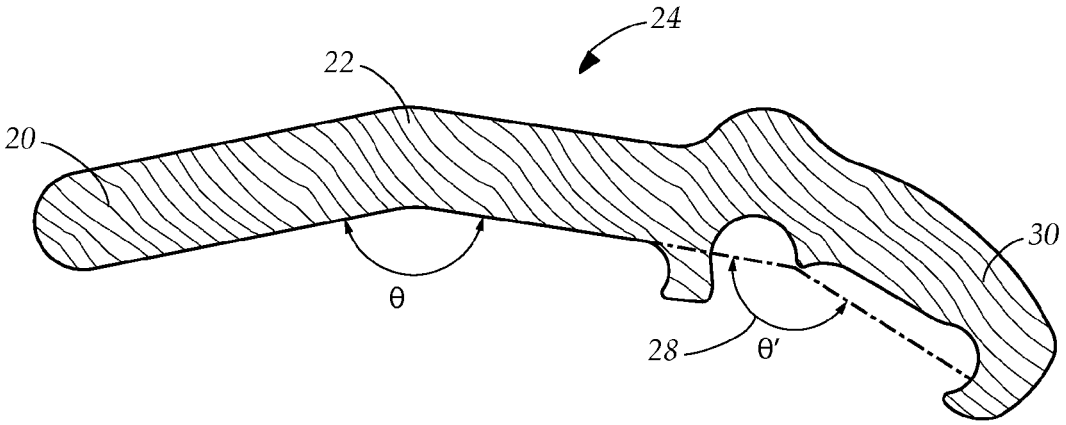
FIG. 3 is a side elevational view of the climbing tool.

FIG. 3 shows a side elevational view of the tool showing the obtuse angle 22 of the shaft 20 and the inward bias angle θ' 28 of the grip 30 to the shaft. The angle 28 of the inward bias of the grip from the shaft is about 160 degrees with a range of about 140 degrees to 170 degrees, and the angle 22 in the shaft portion is about 160 degrees, with a range of about 140 degrees to 170 degrees, providing an appropriate skeletal wrist angle when grasped.

FIG. 3 also shows a thin layer 24 of wood forming one of a plurality of thin, overlaid layers 24 forming a solid shaft 20 and grip 30. The solid shaft and grip have a smooth sanded surface when the layers are coupled together, one layer overlaid on the other. FIG. 2A shows a cross section of the climbing tool showing the plurality of layers 24A, 24B from the back 20B of the shaft. It is understood that this is one embodiment of forming the shaft and grip and the formation of the tool is not limited to this embodiment. For example, the shaft and grip can be manufactured from, but not limited to, steel, titanium, or molded resin.

Figure 4:
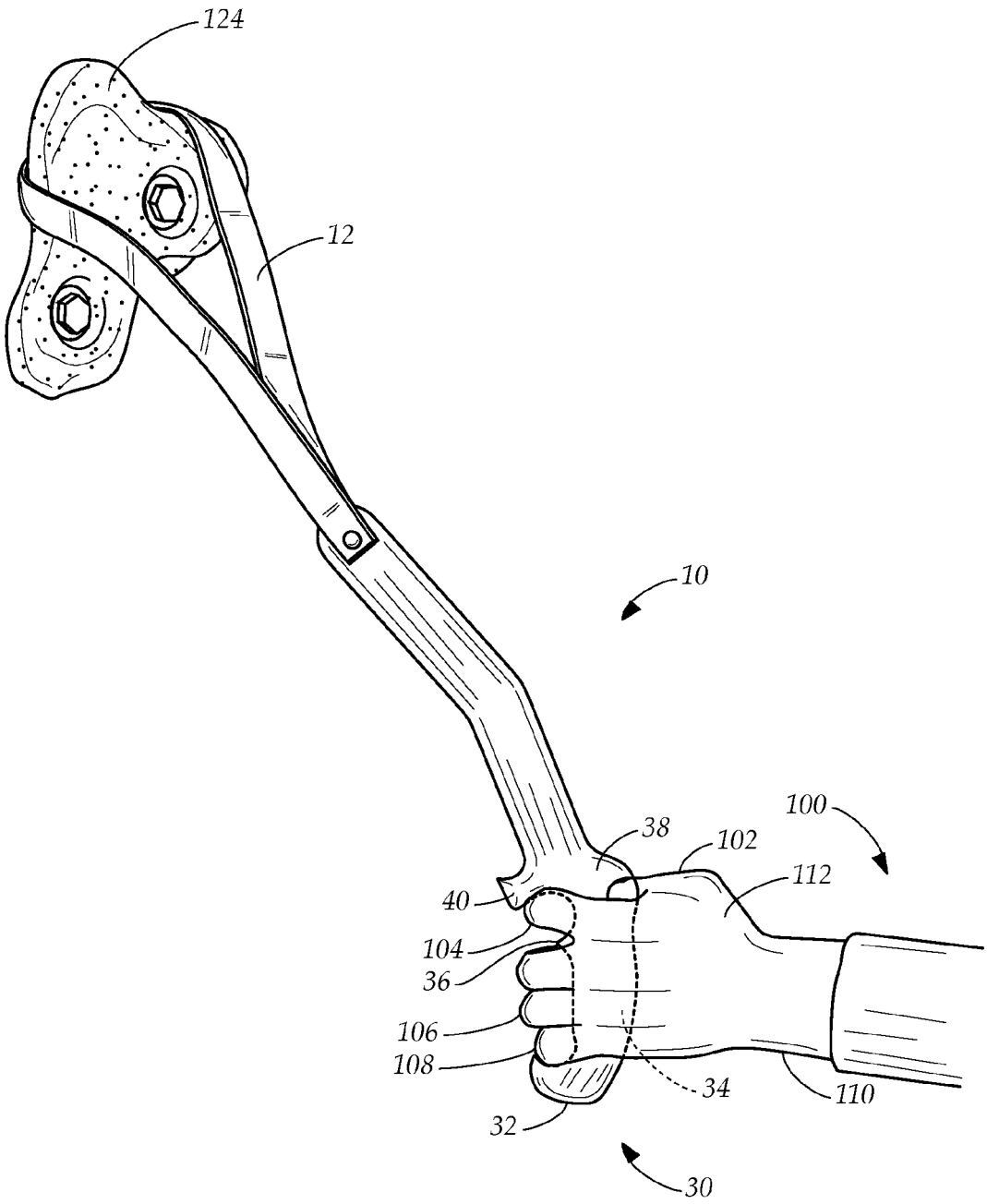
FIG. 4 is a perspective view of the climbing tool engaging a hold on a climbing wall.

FIG. 4 demonstrates the climbing tool 10 in use by a user 100. The angles of the tool described hereinabove are designed for the appropriate skeletal angle of a user's wrist 110 needed for climbing on the artificial climbing wall. The wrist is straight as it pulls up on the grip of the tool 10. A pinky finger 108 rests on the pinky rest 32, an index finger 104 on the finger rest 35, and a plurality of remaining fingers 106 grip the grasping section 36. A thumb 102 counterbalances the grip 30 by placing the thumb on the thumb rest 38 on the opposing side.

The user 100 loops the strap around the hold 124 on the climbing wall using the same pulling motion used when dry tooling on rock.

Figure 5:
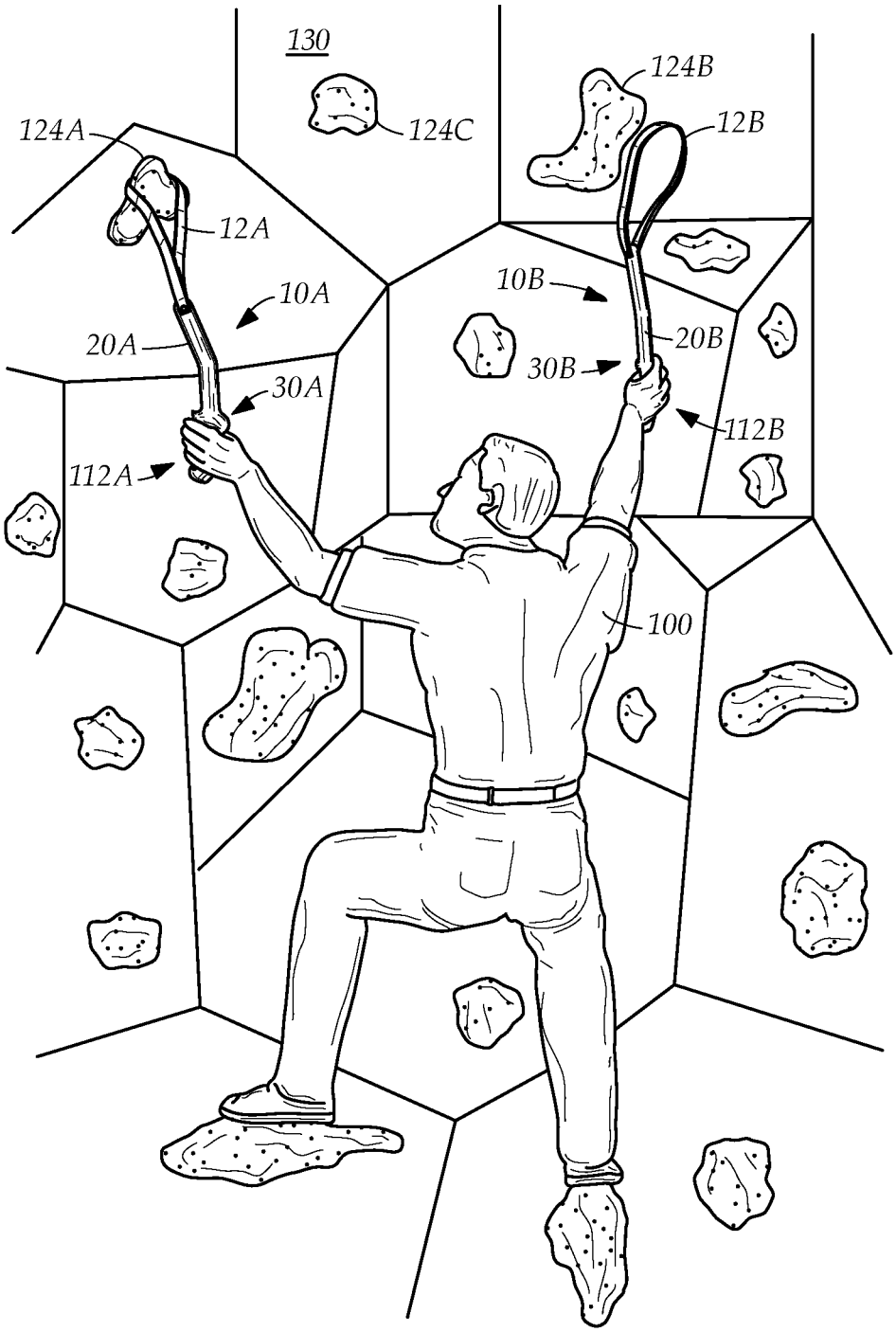
FIG. 5 is a perspective view of a user climbing a climbing wall using a pair of climbing tools.

FIG. 5 shows the user climbing the artificial climbing wall 122 having a plurality of holds 124 using a pair of climbing tools 10. The user 100 engages a first hold 124A on an artificial climbing wall 130 with the strap 12A of the first climbing tool 10A while gripping the grip 30A of the first climbing tool in a first hand 112A. The user 100 engages a second hold 124B on the wall by looping the strap 12B of the second climbing tool 10B while gripping a grip of the second climbing tool in a second hand.

In the example illustrated in FIG. 5, the user 100 moves upwards on the wall 130, maintaining a direction parallel and upwards with the shaft 20A of the first tool 10A, up and past the first hold 124A, keeping the loading on the first climbing tool 10A.

The user 100 engages a further hold 124C on the wall 130 with the strap 12A of the first climbing tool 10A while moving upwards on the wall, maintaining a direction parallel with a shaft 20B of the second tool 10B, up and past the second hold 124B, keeping the loading on the second climbing tool 10B. These movements are repeated until the user reaches a top of the wall. It is understood by those of ordinary skill that this is just one series of movements possible with the climbing tool and the description is provided as a non-limiting example. Dry tool climbing is fairly free form and creative with many different movements possible using the climbing tool described herein.

In a further non-limiting example of a climbing movement, the user 100 engages the strap 12A of the first climbing tool 10A on a first hold 124A while gripping the grip 30A of the first climbing tool 10A in the first hand 112A, and further engages the same hold 124A with the strap 12B of the second climbing tool 10B while gripping the grip 30B in the second hand 112B, performing a match maneuver, operative for a first hand moving to the second climbing tool.

As shown in FIG. 4, the user 100 can engage the hold on the wall with the strap 12 of the climbing tool 12 with the first hand 112 and gripping the shaft of the climbing tool above the rest 40 with the second hand (not shown), the first hand then grips the second climbing tool and engages the strap of the second tool with a further hold traverse to the first hold, thereby traversing the wall.

A method of manufacturing the climbing tool 10 is illustrated by FIG. 1. The angled shaft 20 having the front 20F and the back 20B, the shaft 20 further having a distal end 20D and a proximal end 20P is formed with the obtuse angle 22 therebetween.

The grip 30 having a front 30F and an opposing back 30B facing away from the user, a proximal portion 30P and a distal portion 30D is formed and the distal portion 30D is coupled to the proximal end 20P of the shaft 20 at the angle 28 biasing inward toward the front 30F. In one embodiment, the grip 30 is integral to the shaft 20.

The grip is formed with the pinky rest 32 at the front 30F proximal end 30P, the grasping portion 34 between the proximal portion 30P of grip and the distal portion 30D of the grip, the finger rest 36 in the grasping portion, the finger rest 36 protruding to the front 30F.

The grip 30 is formed with the thumb rest 38 at the distal portion 30D protruding to the back 30B, and a match rest 40 at the distal portion 30D protruding to the front 30F.

The shaft 20 and grip 30 are preferably manufactured from wood and are formed by layering a plurality of thin overlaid layers of wood forming solid shaft 20 and grip 30 which are sanded to have a smooth, sanded surface. As explained hereinabove, other materials are possible within the inventive concept.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected as described hereinabove.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a tool for climbing an artificial climbing wall. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method of climbing an artificial climbing wall with a pair of climbing tools, each climbing tool having a strap, a shaft and a grip, comprising:

engaging a first hold on an artificial climbing wall with a first strap of a first climbing tool while gripping a first grip of the first climbing tool in a first hand, the first grip having a first pinky rest, a first grasping portion, a first finger rest in the first grasping portion, and a first thumb rest, a user gripping the first grip by placing a middle finger and a ring finger on the first hand in the first grasping portion, placing a pinky finger on the first hand on the first pinky rest, an index finger on the first hand on the first finger rest in the first grasping portion, the user curling the index, middle and ring fingers on the first hand around the first grasping portion and counterbalancing the first grip by placing a thumb on the first hand on the first thumb rest;

engaging a second hold on an artificial climbing wall with a second strap of a second climbing tool while gripping a second grip, the second grip on the second climbing tool in a second hand;

moving upwards on the wall, maintaining a direction parallel and upwards with a shaft of the first tool, up and past the first hold, keeping a loading on the first climbing tool; and engaging a further hold on the wall with the first strap of the first climbing tool while moving upwards on the wall, maintaining a direction parallel with a shaft of the second tool, up and past the second hold, keeping said loading on the second climbing tool.

2. The method of climbing an artificial climbing wall with a pair of climbing tools as described in claim 1, wherein each grip has a distal end having a match rest and the method of climbing the wall further comprises the step of engaging the first hold on the wall with the first strap of the first climbing tool, gripping the grip of the first climbing tool with the first hand and gripping the shaft of the first climbing tool above the first match rest with the second hand, the first hand gripping the second climbing tool and engaging the second strap of the second tool with a traverse hold, traverse to the first hold, thereby traversing the wall.

3. The method of climbing an artificial climbing wall with a pair of climbing tools as described in claim 1, further comprises the step of engaging the first hold on an artificial climbing wall with the first strap of the first climbing tool while gripping the grip of the first climbing tool in a first hand, and engaging the first hold with the second strap of the second climbing tool while gripping the grip of the second climbing tool in the second hand, performing a match maneuver.

* * * * *